US005122002A

United States Patent [19]

Daggs

[11] Patent Number: 5,122,002

[45] **Date of Patent: * Jun. 16, 1992**

[54] RIBBON CARTRIDGE WITH CORRECTION CARTRIDGE LOCK-OUT CIRCUMVENTION POWER SWITCH PROJECTION

[75] Inventor: Robert W. Daggs, Simi Valley, Calif.

[73] Assignee: General Ribbon Corporation, Charsworth, Calif.

[ * ] Notice: The portion of the term of this patent subsequent to Dec. 3, 2008 has been disclaimed.

[21] Appl. No.: 775,338

[22] Filed: Oct. 11, 1991

Related U.S. Application Data

[63] Continuation of Ser. No. 546,326, Jun. 29, 1990, Pat. No. 5,069,563.

[51] Int. Cl.[5] ..... B41J 32/00

[52] U.S. Cl. ..... 400/208; 400/247; 200/61.58 R

[58] Field of Search ..... 400/194, 195, 196, 196.1, 400/207, 208, 208.1, 219.1, 225, 247, 248, 216.1, 216.2, 233, 249, 697.1; 200/61.58 R

[56] References Cited

U.S. PATENT DOCUMENTS

| | | | |
|---|---|---|---|
| 3,773,781 | 5/1973 | Caudill | 400/208 |
| 4,239,107 | 12/1980 | Boyatt | 206/225 |
| 4,247,210 | 6/1981 | Kacmarcik | 400/236.1 |
| 4,302,118 | 11/1981 | Schaefer | 400/208 |
| 4,329,072 | 5/1982 | Kacmarcik | 400/208 |
| 4,347,007 | 8/1982 | Schaefer | 400/208 |
| 4,350,453 | 11/1982 | Field | 400/208 |
| 4,353,657 | 10/1982 | Schaefer | 400/208 |
| 4,397,575 | 8/1983 | Aldrich | 400/208 |
| 4,407,593 | 10/1983 | Haftman | 400/208 |
| 4,516,137 | 5/1985 | Yasui | 346/76 |
| 4,609,422 | 9/1986 | Becking | 400/196.1 |
| 4,611,936 | 9/1986 | Yasui | 400/120 |
| 4,611,938 | 9/1986 | Rettke | 400/212 |
| 4,616,945 | 10/1986 | Komplin | 400/697.1 |
| 4,636,097 | 1/1987 | Goubeaux | 400/196.1 |
| 4,683,478 | 7/1987 | Suziki et al. | 400/233 |
| 4,712,933 | 12/1987 | Natsume | 400/248 |
| 4,747,714 | 5/1988 | Moritz | 400/214 |
| 4,798,489 | 1/1989 | Shiota | 400/216.1 |
| 4,834,367 | 5/1989 | Ueno | 400/233 |
| 4,867,587 | 5/1989 | Kishida et al. | 400/216.2 |
| 4,900,171 | 2/1990 | Mueller | 400/208 |

FOREIGN PATENT DOCUMENTS

| | | |
|---|---|---|
| 2705127 | 10/1977 | Fed. Rep. of Germany . |
| 3346482 | 7/1984 | Fed. Rep. of Germany . |
| 56-144985 | 11/1981 | Japan . |
| 59-78879 | 5/1984 | Japan . |
| 59-93376 | 5/1984 | Japan . |
| 61-31284 | 2/1986 | Japan . |
| 61-146576 | 7/1986 | Japan . |
| 2179917 | 3/1987 | United Kingdom . |

OTHER PUBLICATIONS

IBM Tech. Discl. Bulletin, by M. H. Buehholz and R. W. Lissner, "Web-tension Sensing Device", vol. 25, No. 4, Sep. 1982, pp. 2066-2067.

IBM Tech. Discl. Bulletin, by J. A. Craft, "Lowest Cartridge Code Detector", vol. 25, No. 4, Sep. 1982, pp. 1980-1981.

IBM Tech. Discl. Bulletin, by W. D. Dunning and N. E. Hosie, "Protective Carton", vol. 25, No. 4, Sep. 1982, pp. 1944-1945.

IBM Tech. Discl. Bulletin, by W. M. Jenkins, "End-of-Ribbon Sensor and Cartridge-Present Indicator", vol. 27, No. 6, Nov. 1984, pp. 3645-3647.

IBM Tech. Discl. Bulletin, by J. O. Schaefer, "Two--Color Cartridge Carbon System with Correction", vol. 22, No. 6, Nov. 1979, pp. 2327-2329.

IBM Tech. Discl. Bulletin, by W. D. Thorne, "Page Width Ribbon Cartridge and Drive Mechanism", vol. 25, No. 4, Sep. 1982, pp. 2020-2022.

IBM Tech. Discl. Bulletin, by J. W. Wenner, "Constant Head Wrap Tape Drive", vol. 25, No. 4, Sep. 1982, p. 2068.

IBM Tech. Discl. Bulletin, By D. J. Winarski, "Web--Guiding Stress Functions", vol. 25, No. 4, Sep. 1982, p. 2069.

IBM Tech. Discl. Bulletin, By B. D. Purcell, "Stuffer Ribbon Cartridge", vol. 25, No. 4, Sep. 1982, pp. 2153-2154.

*Primary Examiner*—Eugene H. Eickholt

[57] ABSTRACT

An ink ribbon cassette includes a top, a bottom, sides disposed between the top and bottom, a ribbon chamber disposed between the top and bottom, a ribbon outlet extending from the chamber, a ribbon inlet extending into the chamber, and a positionable tab disposed on the cartridge for actuating a power switch on a device in which the cartridge may be mounted.

11 Claims, 3 Drawing Sheets

RIBBON CARTRIDGE WITH CORRECTION CARTRIDGE LOCK-OUT CIRCUMVENTION POWER SWITCH PROJECTION

This is a continuation of application Ser. No. 07/546,326, filed Jun. 29, 1990, now U.S. Pat. No. 5,069,563.

BACKGROUND OF THE INVENTION

The field of the present invention is cartridges for ribbons used in printing, including cartridges to be mounted in stacked relation with other cartridges in a printing device.

Ribbon and tape cartridges for use in printing devices such as typewriters and the like are known. Cartridges containing ribbon are typically used to transfer information from the printing device to a tangible medium such as a sheet of paper. Cartridges containing tape are typically used for making corrections to previously printed matter.

In some printing apparatus, an ink ribbon cartridge and correction tape cartridge are simultaneously mounted in stacked relation in the printing device such that printing and correction can be performed without exchanging cartridges. In some cases, the printing apparatus includes a power activation switch that is activated by a tab extending from an overlying ink ribbon cartridge when the ink ribbon cartridge is properly positioned in the printing device. Because the correction tape cartridge is positioned between the ink ribbon cartridge and the printer, it is provided with a corresponding slot to receive the tab extending from the ink ribbon cartridge and permit the tab to extend to the power activation switch. An arrangement of this type is shown in U.S. Pat. No. 4,900,171, the contents of which are incorporated in full herein by this reference.

In the arrangement of U.S. Pat. No. 4,900,171, a first ink ribbon cartridge includes a single tab that is fixedly positioned in a first position in alignment with an associated slot in a first underlying correction tape cartridge and in alignment with a first underlying power activation switch. In a second ink ribbon cartridge, a tab is fixedly positioned in an alternate second position spaced from the first tab position so as to align with an associated slot in a second underlying correction tape cartridge and an associated second power activation switch. With such an arrangement, the resultant combination of ink ribbon and correction tape cartridges which may be used together in a printing device are limited to those which have mutually aligned tabs and slots. A ribbon cartridge having a tab which does not align with the slot in the underlying correction cartridge cannot operate the power activation switch and the printer cannot be used.

In order to enhance the field of use of ink ribbon cartridges having a fixed tab, in order that such cartridges can be used with a greater number of correction tape cartridges, some manufacturers have provided correction cartridges having a pair of slots that are adapted to receive tabs located in either of the aforementioned first and second tab positions and thus enable the tabs to engage an associated underlying power activation switch. Other manufacturers have proposed tape cartridges having a single elongated slot spanning both the first and second tab positions. Still other manufacturers have proposed tape cartridges having no central surface area to block the ribbon cartridge tabs and such cartridges therefore have no slots. Correction tape cartridges of this type do not physically lock out ribbon cartridges with incompatible tabs, and can be freely used with either of the aforementioned first and second ribbon cartridges. A "non-lockout" system is thus provided that does not assure or require cartridge compatibility.

Notwithstanding the foregoing use of two-slot, elongated-slot and no-slot correction tape cartridges, users who wish to purchase single slot correction tape cassettes are still restricted as to the type of overlying ink ribbon cassette which may be employed, and such consumers are forced to purchase only those ribbon cartridges having compatibly positioned fixed tabs. Accordingly, there is an evident need for an ink ribbon cassette that is operable with a plurality of tape cartridges including single-slot, double-slot, elongated-slot and no-slot cartridge configurations. Such a ribbon cartridge would not be physically prevented from operating with tape cartridges designed to lock out certain ribbon cartridges.

SUMMARY OF THE INVENTION

The present invention is directed to an ink ribbon cartridge that avoids imposing structural means for limiting the number of correction tape cartridges that are usable therewith, and which is operable with single-slot, double-slot, elongated-slot or no-slot correction cartridges. To that end, positionable means may be employed on the ink ribbon cartridge, in order to actuate an underlying power activation switch. In that manner, a correction tape cartridge having a pre-positioned slot designed to lock out non-compatible ink ribbon cartridges cannot so function.

DETAILED DESCRIPTION OF PREFERRED EMBODIMENTS

Figure 1:
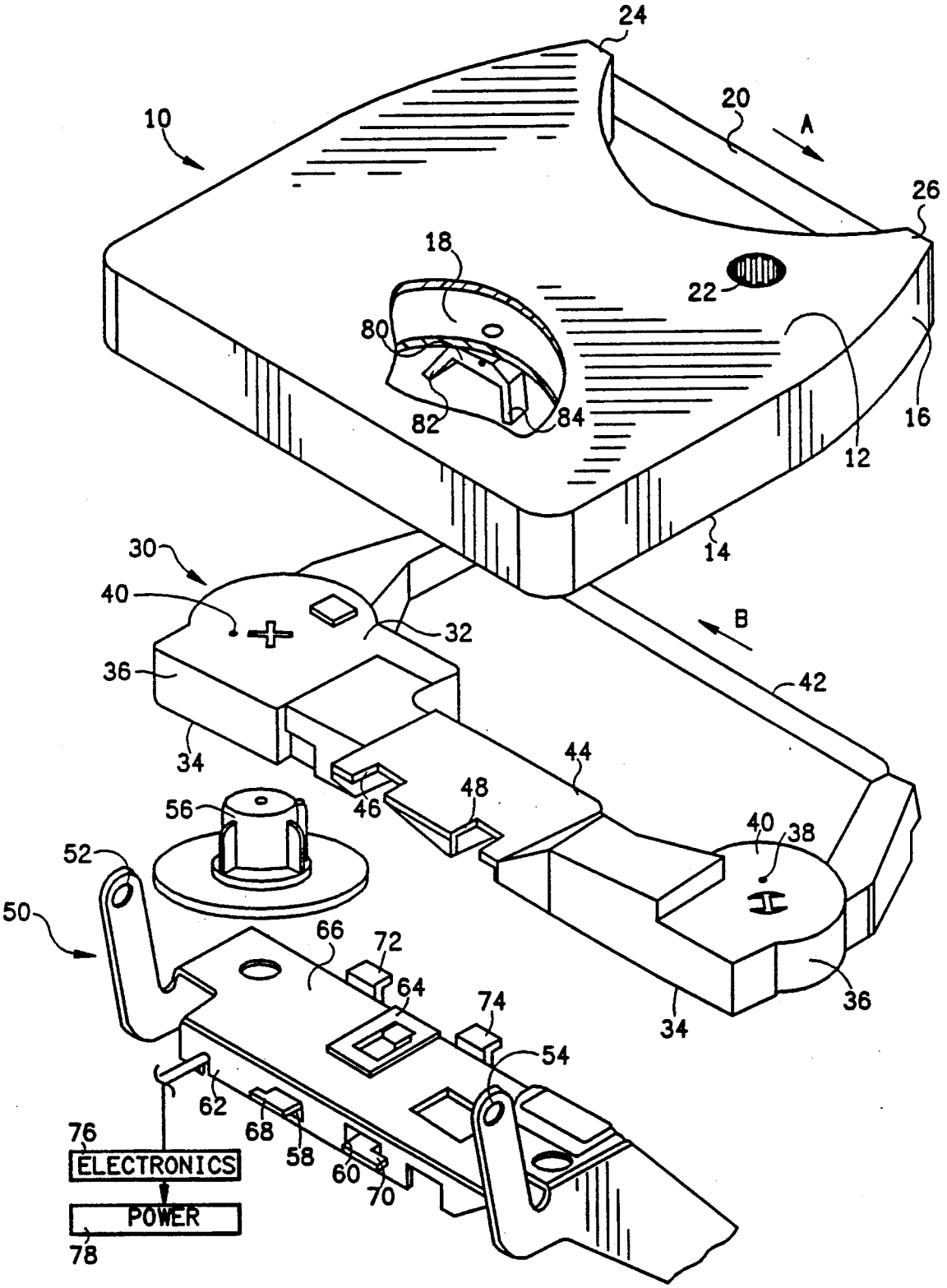
FIG. 1 is an exploded isometric projection of an ink ribbon cartridge constructed in accordance with the present invention, in association with an underlying correction tape cartridge and a printing device, as these elements would be arranged for use in printing, the ink ribbon cartridge having a portion thereof broken away for clarity to show an aspect of the lower surface thereof.

Turning now to FIG. 1, an ink ribbon cassette 10 includes the usual top 12, bottom 14 and side portions 16 extending between the top 12 and the bottom 14. The ink ribbon cartridge 10 further includes an interior ink ribbon chamber 18 disposed between the top 12 and the bottom 14 that houses the usual roll of ink ribbon 20 on a supply spool (not shown). A take up spool (not shown) mounted adjacent to and in engagement with a drive spindle 22 provides a ribbon take up as it is rotated by a printer drive element (not shown) that engages the drive spindle 22, and draws the ribbon 20 in the direction shown by the arrow "A" from a ribbon outlet 24 extending from the ribbon chamber 18 and into a ribbon inlet 26 extending into the ribbon chamber 18.

Underlying the ink ribbon cartridge 10 is a correction tape cartridge 30 that includes top portions 32, bottom portions 34 and side portions extending between the top portions 32 and the bottom portions 34. The correction tape cartridge further includes a supply compartment 38 having disposed therein a supply spool (not shown) and a take up compartment 40 having a take up spool (not shown) disposed therein. Extending between the supply compartment 38 and the take up compartment 40 is a correction tape 42 which is driven in the direction shown by the arrow "B." The correction tape cartridge 30 further includes a central face 44 in which are disposed a pair of slots 46 and 48. Alternatively, there could be disposed only a single slot in one of the positions occupied by the slots 46 and 48, or there could be a single elongated slot extending over the positions of the slots 46 and 48, or there could be no central surface area at all and hence no slots.

The ink ribbon cartridge 10 and the correction tape cartridge 30 are mounted in stacked relation on a shiftable bracket 50 which is pivotally mounted at pivot points 52 and 54 to a conventional printing apparatus. The shiftable bracket 50 has mounted thereon a correction tape drive spindle 56 which engages the spool disposed in the take up compartment 40 in the correction tape cartridge 30. The shiftable bracket 50 further includes an opening 58 and an opening 60 in a front portion 62. A clip 64 is arranged on a central face portion 66 of the shiftable bracket 50. A power on-off switch of conventional design is mounted to the shiftable bracket 50 and includes a first finger 68 extending through the opening 58 of the shiftable bracket section 62. The first finger 68 provides a first pivot point. A second finger 70 of the power switch extends through the opening 60 in the shiftable bracket section 62 to provide a second pivot point. The power switch further includes a pair of rearwardly and upwardly extending power activation fingers 72 and 74 which are connected to the pivot fingers 68 and 70, respectively. A spring (not shown) biases the on-off switch rocker so that the fingers 72 and 74 are urged upwardly. In that manner, the fingers 72 and 74 are downwardly pivotable about the pivot points 68 and 70, respectively. The power switch is electricity connected in a conventional fashion to an electrical circuit 76 and a power source 78. With the fingers 72 and 74 in the upwardly biased position, the printing apparatus is deactivated. Should a downwardly directed force of sufficient magnitude be applied to either of the fingers 72 or 74, the power switch will activate the printer.

As shown in FIG. 1, the printing device is activated when the ink ribbon and correction tape cartridges are mounted thereon by means of a rocker assembly 80 disposed on the bottom of the ink ribbon cartridge 10. The rocker assembly 80, described in detail hereinafter, includes a pair of tabs 82 and 84 serving as printer power activation means which are positionable to extend through either of the slots 46 or 48, or both, to actuate one or both of the fingers 72 and 74. As used herein, postionable refers both to active positioning by a user or other external agency prior to cartridge insertion in the printer, and passive positioning achieved during cartridge insertion wherein the tabs or other printer activation means adjust to a default position by contact with an area of an associated tape cartridge or printer.

Figure 2:
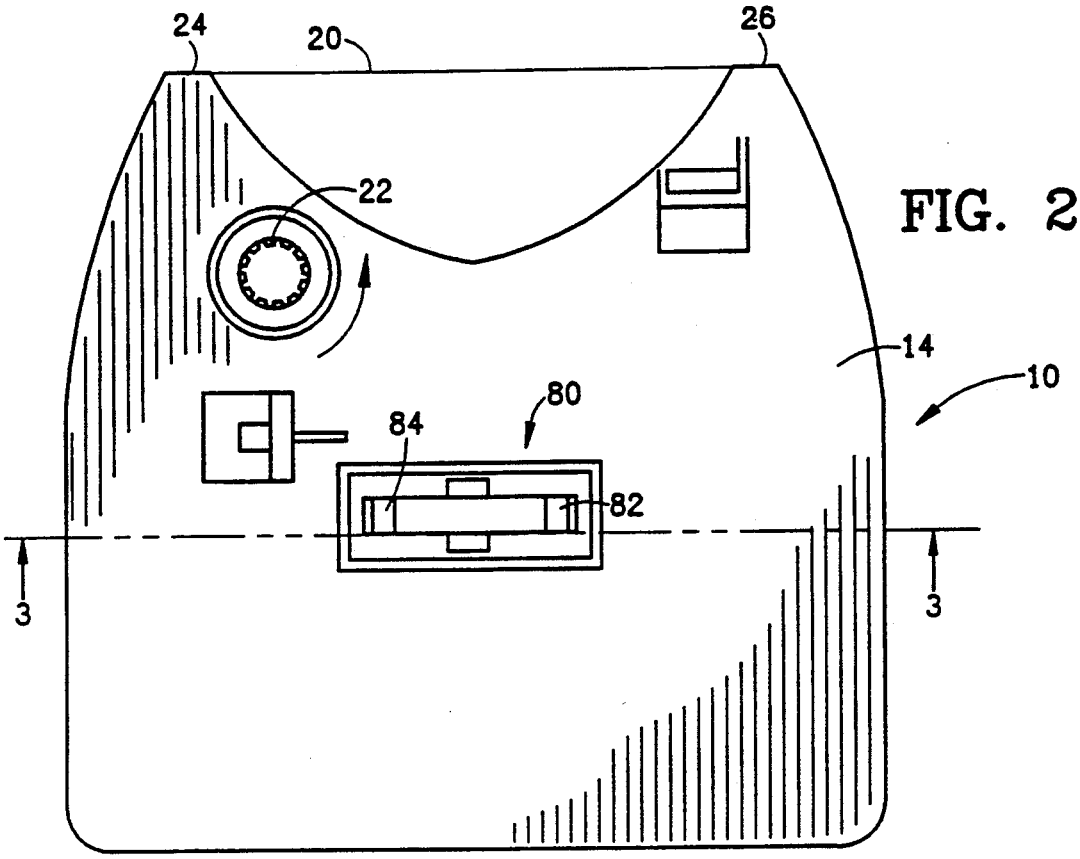
FIG. 2 is a bottom view of the ink ribbon cartridge of FIG. 1.
Figure 3:
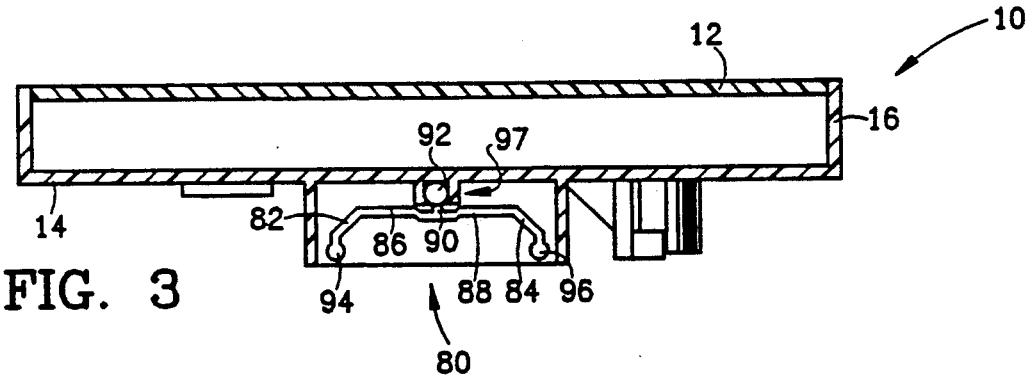
FIG. 3 is a cross-sectional view of the ink ribbon cartridge of FIG. 1 taken along line 3—3 in FIG. 2.
Figure 4:
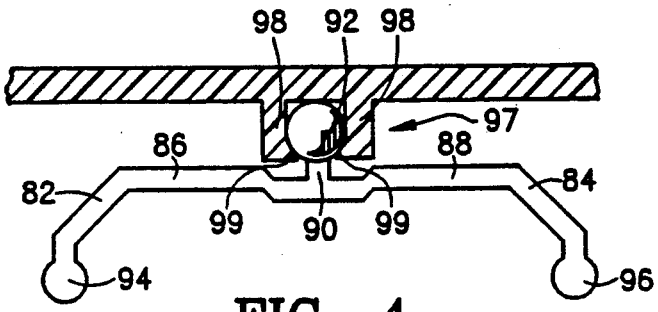
FIG. 4 is a detailed cross-sectional view of a portion of the ink ribbon cartridge shown in FIG. 3.

Turning now to FIGS. 2, 3 and 4, the tabs 82 and 84 extend from the ends of a generally T-shaped support arm member, having a pair of laterally extending support arms 86 and 88, respectively. The support arms 86, 88 in turn are mounted to a central stem element 90 having a pivotable ball element 92 disposed at the end thereof. The tabs 82 and 84 themselves include a pair of switch engagement members 94 and 96, respectively, which are adapted to engage and press one or both of the fingers 72 and 74 of the on-off switch, depending on the pivotal position of the rocker assembly. The ball element 92 is pivotally attached to the bottom 14 of the cartridge 10 by means of a clip 97 having a pair of side members 98, each having a lip 99 at the end to engage the ball element 92 and retain it in position against the bottom 14 of the cartridge 16.

It will be appreciated that if the ribbon cartridge 10 is used with a tape cartridge having only a single slot in either of the positions occupied by the slots 46 and 48, one of the rocker assembly elements 94 or 96 will strike the tape cartridge surface 44, causing the rocker assembly to pivot to a position in which the other element 94 or 96 is urged through the cartridge slot and against one of the fingers 72 or 74. In the case of a cartridge having a pair of slots, the elements 94 and 96 may be positioned to engage both of the fingers 72 and 74.

Figure 5:
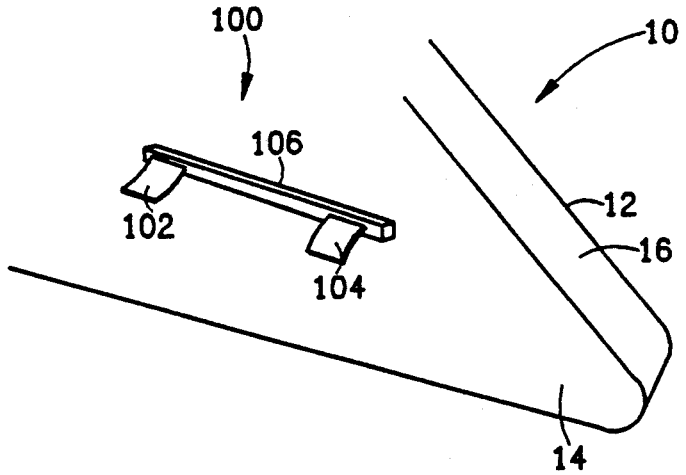
FIG. 5 is a partial diagrammatic bottom view of an ink ribbon cartridge constructed in accordance with another aspect of the present invention.

Turning now to FIG. 5, an alternative embodiment is shown wherein the rocker assembly 80 is replaced with a tab assembly 100 wherein a pair of flexible tabs 102 and 104 made from a suitable flexible material are mounted to an elongated support 106 that is fixedly attached to the bottom 14 of the cartridge 10. The tabs 102 and 104 are sufficiently flexible to bend from a position wherein they extend substantially perpendicular to the bottom 14, to a position wherein they lie substantially parallel thereto. In operation, both of the tabs 102 and 104 are free to extend through a correction tape cassette having a pair of slots 46 and 48 therein. In correction tapes having only a single slot 46 or 48 one of the tabs 102 or 104 will extend through the associated slot while the other tab will bend upon contact with the correction tape cartridge surface 44 until it is substantially parallel to the bottom surface 14 of the ink ribbon cartridge 10.

Figure 6:
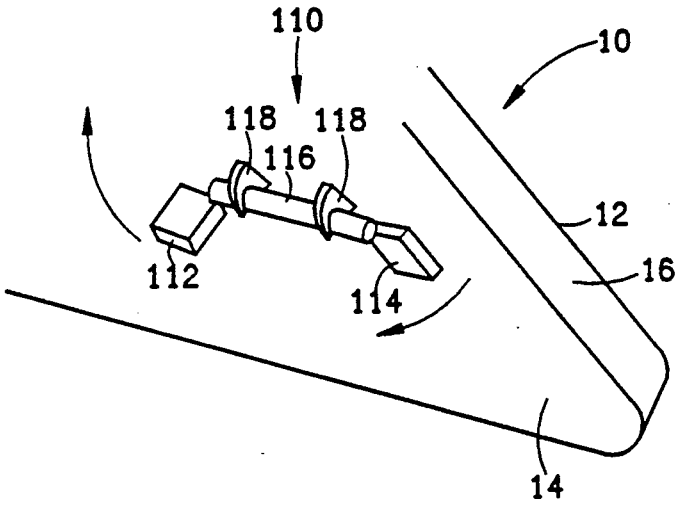
FIG. 6 is a partial diagrammatic view of an ink ribbon cartridge constructed in accordance with yet another aspect of the present invention.

Turning now to FIG. 6, yet another embodiment is shown wherein the rocker assembly 80 is replaced with a tab assembly 110 that includes a pair of tabs 112 and 114 mounted to the ends of an axially pivotable post 116. The post 116 is pivotally mounted to a pair of mounting supports 118 that are attached to the bottom 14 of the ink ribbon cartridge 10. The tabs 112 and 114 are mounted on the post 116 so as to extend approximately perpendicularly to one another as shown in FIG. 6. In fact, it may be preferable to orient the tabs 112 and 114 at an angle with respect to each other of slightly more than 90°. Thus, when the tab 112 is oriented adjacent to the bottom 14 of the ink ribbon cassette 10, the tab 114 is oriented in a slightly overcenter position of greater than 90° with respect to the bottom 14, and visa versa. In this manner, the cartridge of FIG. 6 can be used with a tape correction cartridge having a slot 46 or a slot 48, or both, except that only one of the tabs 112, 114 can extend through the correction tape cartridge at a given time.

Figure 7:
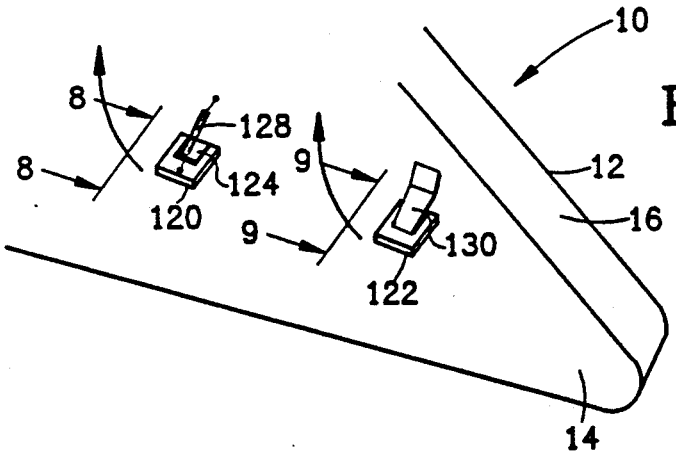
FIG. 7 is a partial diagrammatic view of an ink ribbon cartridge constructed in accordance with a still further aspect of the present invention.
Figure 8:
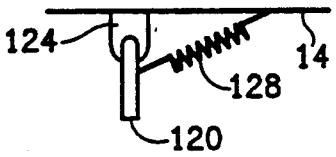
FIG. 8 is a detailed side view of one of the tab assemblies of FIG. 7 showing use of a first alternative spring configuration.
Figure 9:
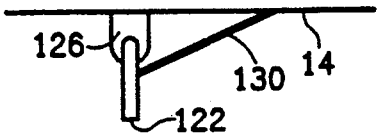
FIG. 9 is a detailed side view of one of the tab assemblies of FIG. 7 showing use of a second alternative spring configuration.

Referring now to FIGS. 7, 8 and 9, a still further embodiment is shown wherein the rocker assembly 80 is replaced with a pair of independent tab elements 120 and 122, each being pivotally mounted to an independent support mount 124 and 126, respectively, attached to the bottom 14 of the cartridge 10. Both of the tab elements 120 and 122 may be biased by either of springs 128 and 130, representing alternative spring designs, from an orientation substantially parallel to the bottom 14 to a position wherein the tabs are oriented substantially perpendicular thereto. In that manner, the cartridge of FIG. 7 may also be used with a tape correction cartridge having a slot 46 or a slot 48, or both.

In accordance with the above, an improved ink ribbon cassette is provided. It is understood that the foregoing description and accompanying illustrations are merely exemplary and are in no way intended to limit the scope of the invention, which is defined solely by the appended claims and their equivalents. Various changes and modifications to the preferred embodiments should be apparent to those skilled in the art. For example, it would be possible to provide a positionable tab that is slideable between a plurality of positions for alignment with an underlying tape cartridge slot. Such changes and modifications can be made without departing from the spirit and scope of the invention. According, it is intended that such changes and modifications be covered by the appended claims and equivalents.

What is claimed is:

1. A ribbon cartridge for mounting on a device, said ribbon cartridge comprising a top, a bottom, a plurality of sides and a ribbon chamber disposed between said top and said bottom, said ribbon cartridge further including a ribbon outlet extending from said chamber, a ribbon inlet extending into said chamber, and a projection disposed on said cartridge positionable to circumvent a lock-out portion of a correction cartridge mountable between the ribbon cartridge and the device, and to actuate a power switch in the device in which the cartridge may be mounted.

2. The ribbon cartridge of claim 1 wherein said projection is positionable to circument a lock-out portion of a correction cartridge having one or more slots therein overlying one or more power activation switches in the device.

3. The ribbon cartridge of claim 1 wherein said projection is positionable to circumvent a lock-out portion of a correction cartridge having plural slots therein overlying plural power activation switches in the device.

4. The ribbon cartridge of claim 1 wherein said projection is positionable to circumvent a lock-out portion of a correction cartridge having a single slot therein.

5. The ribbon cartridge of claim 2 wherein said projection is positionable through one or more of said slots.

6. In a ribbon cartridge to be mounted in stacked relation with a correction cassette in a device having one or more power activation switches therein, the correction cassette having one or more lock-out portions between slots overlying one or more of the power activation switches, the improvement comprising a positionable projection extending from the ribbon cartridge for circumventing the one or more lock-out portions of the correction cartridge to engage one or more of the power activation switches in the device.

7. The ribbon cartridge of claim 6 wherein said projection is positionable to circument a lock-out portion of a correction cartridge having one or more slots therein overlying one or more power activation switches in the device.

8. The ribbon cartridge of claim 6 wherein said projection is positionable to circumvent a lock-out portion of a correction cartridge having plural slots therein overlying plural power activation switches in the device.

9. The ribbon cartridge of claim 6 wherein said projection is positionable to circumvent a lock-out portion of a correction cartridge having a single slot therein.

10. The ribbon cartridge of claim 7 wherein said projection is positionable through one or more of said slots.

11. A printing system including a correction capability, comprising in combination:

a printing device having plural power activation members, and a cartridge holding area positioned adjacently above said power activation members;

a correction cassette mounted on said printing device in said cartridge holding area, said correction cartridge having a housing and a quantity of a correction ribbon disposed in said housing, said correction cartridge further including a lock-out portion positioned over at least one of said power activation members, and at least one slot overlying at least another of said power activation switches;

a ribbon cartridge mounted on said correction cartridge in a stacked relationship therewith, said ribbon cartridge including a top, a bottom, a plurality of sides, a ribbon chamber disposed between said top and said bottom and a quantity of inked ribbon disposed in said chamber, said ribbon cartridge further including a ribbon outlet extending from said chamber, a ribbon inlet extending into said chamber and a positionable projection disposed on said cartridge for circumventing said lock-out portion of said correction cartridge to activate one of said power switches of said printing device.

* * * * *